US007419236B2

(12) United States Patent
Masuda

(10) Patent No.: US 7,419,236 B2
(45) Date of Patent: Sep. 2, 2008

(54) PRINTING APPARATUS AND POWER SUPPLY CONTROL METHOD

(75) Inventor: Kazunori Masuda, Asaka (JP)

(73) Assignee: Canon Kabushiki Kaisha, Tokyo (JP)

( * ) Notice: Subject to any disclaimer, the term of this patent is extended or adjusted under 35 U.S.C. 154(b) by 200 days.

(21) Appl. No.: 11/492,761

(22) Filed: Jul. 26, 2006

(65) Prior Publication Data

US 2007/0030298 A1 Feb. 8, 2007

(30) Foreign Application Priority Data

Aug. 2, 2005 (JP) ..... 2005-224597

(51) Int. Cl.
*B41J 29/38* (2006.01)

(52) U.S. Cl. ..... 347/14; 347/57

(58) Field of Classification Search ..... 347/14, 347/57

See application file for complete search history.

(56) References Cited

U.S. PATENT DOCUMENTS 6,454,377 B1 * 9/2002 Ishizaki ..... 347/15
6,652,057 B2 11/2003 Masuda et al.
6,831,449 B2 12/2004 Nishida et al.

FOREIGN PATENT DOCUMENTS

JP 2003-211671 7/2003
JP 2003-225997 8/2003

* cited by examiner

*Primary Examiner*—Thinh H Nguyen
(74) *Attorney, Agent, or Firm*—Fitzpatrick, Cella, Harper & Scinto

(57) ABSTRACT

There are provided a printing apparatus having an arrangement capable of stably applying a voltage without using any special power supply control unit, and a power supply control method. According to the method, a signal representing a change of an image signal is generated in the ASIC of the printing apparatus main body. A discharge circuit which is arranged on the power supply path extending from the power supply unit and quickly decreases the voltage upon power-off is also used as a circuit for stabilizing the voltage. While a power supply unit and DC/DC converter with a conventional arrangement are adopted without adding any new component, a compact, low-cost power supply circuit with high voltage stability is implemented.

14 Claims, 11 Drawing Sheets

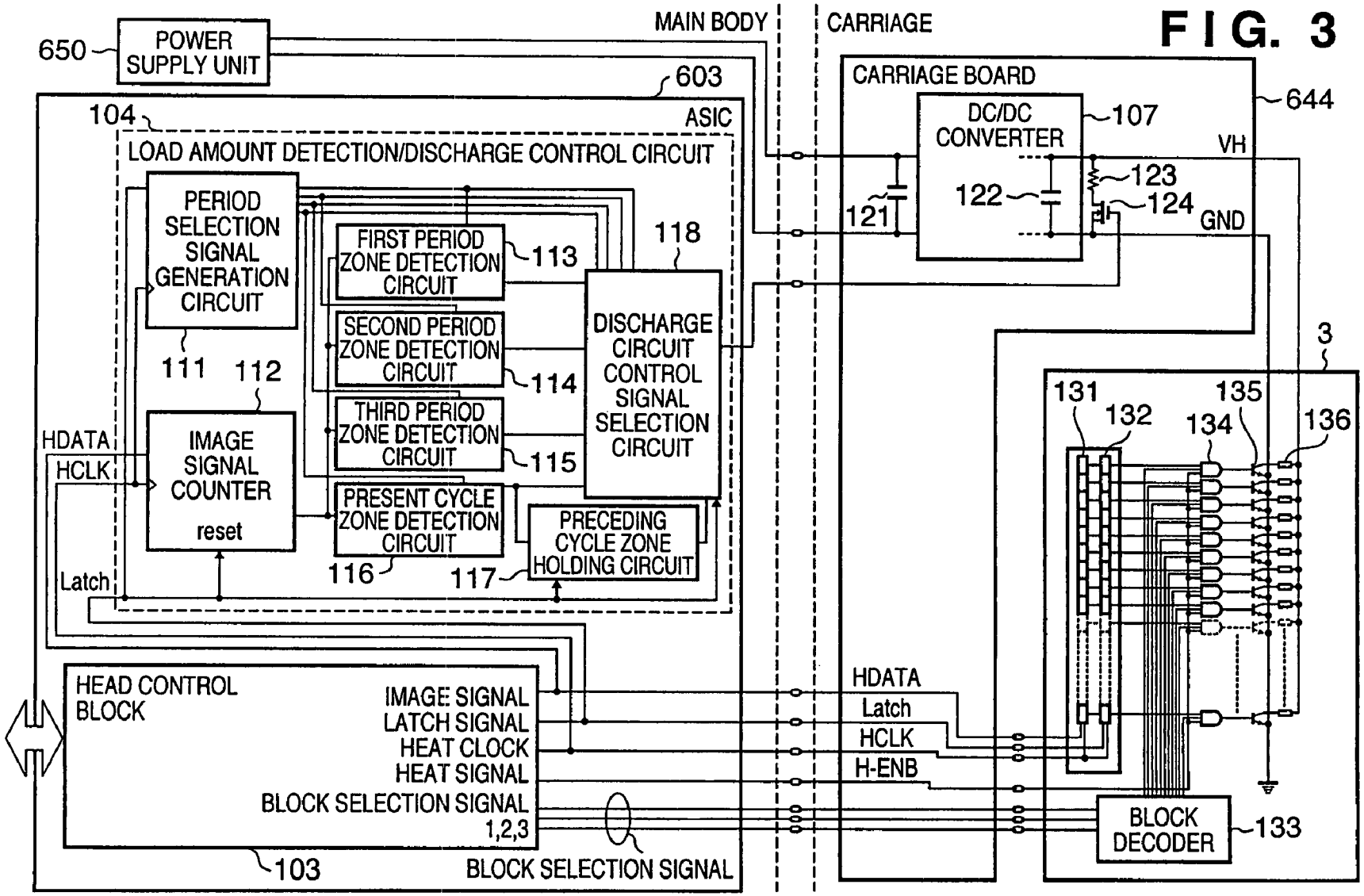
FIG. 3
CARRIAGE
CARRIAGE BOARD
644
107
DC/DC CONVERTER
122
121
123
124
VH
GND
3
136
135
134
132
131
133
BLOCK DECODER
HDATA
Latch
HCLK
H-ENB
MAIN BODY
603
ASIC
LOAD AMOUNT DETECTION/DISCHARGE CONTROL CIRCUIT
118
DISCHARGE CIRCUIT CONTROL SIGNAL SELECTION CIRCUIT
PRECEDING CYCLE ZONE HOLDING CIRCUIT
113
114
115
117
116
FIRST PERIOD ZONE DETECTION CIRCUIT
SECOND PERIOD ZONE DETECTION CIRCUIT
THIRD PERIOD ZONE DETECTION CIRCUIT
PRESENT CYCLE ZONE DETECTION CIRCUIT
111
112
PERIOD SELECTION SIGNAL GENERATION CIRCUIT
IMAGE SIGNAL COUNTER
reset
104
650
POWER SUPPLY UNIT
IMAGE SIGNAL
LATCH SIGNAL
HEAT CLOCK
HEAT SIGNAL
BLOCK SELECTION SIGNAL 1,2,3
BLOCK SELECTION SIGNAL
103
HEAD CONTROL BLOCK

FIG. 6

| ZONE OF PRE-CEDING CYCLE | ZONE OF FIRST PERIOD OF PRESENT CYCLE | ZONE OF SECOND PERIOD OF PRESENT CYCLE | ZONE OF THIRD PERIOD OF PRESENT CYCLE | FIRST PERIOD OF PRESENT CYCLE | SECOND PERIOD OF PRESENT CYCLE | THIRD PERIOD OF PRESENT CYCLE | FOURTH PERIOD OF PRESENT CYCLE |
|---|---|---|---|---|---|---|---|
| 1 | 1 | 1 | 1 | – | non | non | non |
| | | | 2 | | | | |
| | | 2 | 1 | | | | |
| | | | 2 | | | | |
| | | | 3 | | | | |
| | | 3 | 2 | | | data5 (2→4) | |
| | | | 3 | | | | data14 (5→7) |
| | | | 4 | | | | data15 (5→9) |
| | 2 | 1 | 1 | | non | non | non |
| | | | 2 | | | | |
| | | 2 | 1 | | | | |
| | | | 2 | | | | |
| | | | 3 | | | | data6 (2→6) |
| | | 3 | 2 | | | data5 (2→4) | non |
| | | | 3 | | | | data14 (5→7) |
| | | | 4 | | | | data15 (5→9) |
| | 3 | 2 | 1 | | data1 (1→2) | data4 (2→2) | non |
| | | | 2 | | | | non |
| | | | 3 | | | | data11 (3→7) |
| | | 3 | 2 | | | data7(2.5→4) | non |
| | | | 3 | | | | data14 (5→7) |
| | | | 4 | | | | data15 (5→9) |
| | | 4 | 3 | | | data10 (3→6) | data17 (6→7) |
| | | | 4 | | | | data17 (7→9) |
| | 4 | 2 | 1 | | data2 (1→3) | data4 (2→2) | non |
| | | | 2 | | | | non |
| | | | 3 | | | | data11 (3→7) |
| | | 3 | 2 | | | data9 (3→4) | non |
| | | | 3 | | | | data14 (5→7) |
| | | | 4 | | | | data15 (5→9) |
| | | 4 | 3 | | | data13 (4→6) | data17 (6→7) |
| | | | 4 | | | | data17 (7→9) |

FIG. 7

| ZONE OF PRE-CEDING CYCLE | ZONE OF FIRST PERIOD OF PRESENT CYCLE | ZONE OF SECOND PERIOD OF PRESENT CYCLE | ZONE OF THIRD PERIOD OF PRESENT CYCLE | FIRST PERIOD OF PRESENT CYCLE | SECOND PERIOD OF PRESENT CYCLE | THIRD PERIOD OF PRESENT CYCLE | FOURTH PERIOD OF PRESENT CYCLE |
|---|---|---|---|---|---|---|---|
| 2 | 1 | 1 | 1 | – | non | non | non |
| | | | 2 | | | | |
| | | 2 | 1 | | | | |
| | | | 2 | | | | |
| | | | 3 | | | | |
| | | 3 | 2 | | | | |
| | | | 3 | | | | |
| | | | 4 | | | | data6 (2→6) |
| | 2 | 1 | 1 | | non | non | non |
| | | | 2 | | | | |
| | | 2 | 1 | | | | |
| | | | 2 | | | | |
| | | | 3 | | | | |
| | | 3 | 2 | | | | |
| | | | 3 | | | | |
| | | | 4 | | | | data6 (2→6) |
| | 3 | 2 | 1 | | non | non | non |
| | | | 2 | | | | |
| | | | 3 | | | | |
| | | 3 | 2 | | | | |
| | | | 3 | | | | |
| | | | 4 | | | | data6 (2→6) |
| | | 4 | 3 | | | data2 (1→3) | non |
| | | | 4 | | | | data13 (4→6) |
| | 4 | 2 | 1 | | data1 (1→2) | non | non |
| | | | 2 | | | | |
| | | | 3 | | | | |
| | | 3 | 2 | | | | |
| | | | 3 | | | | |
| | | | 4 | | | | data6 (2→6) |
| | | 4 | 3 | | | data7(2.5→4) | non |
| | | | 4 | | | | data7(2.5→4) |

FIG. 8

| ZONE OF PRECEDING CYCLE | | | CUMU-LATIVE ZONE OF PRESENT CYCLE | FIRST PERIOD OF NEXT CYCLE | SECOND PERIOD OF NEXT CYCLE | THIRD PERIOD OF NEXT CYCLE | FOURTH PERIOD OF NEXT CYCLE |
|---|---|---|---|---|---|---|---|
| 3 | - | - | 1 | data18 (7→5) | data12 (4→2.5) | data3 (2→1) | non |
| | | | 2 | non | non | non | ↓ |
| | | | 3 | ↓ | ↓ | ↓ | ↓ |
| | | | 4 | ↓ | ↓ | ↓ | ↓ |
| 4 | - | - | 1 | data20 (9→7) | data16 (6→4) | data8 (3→1) | non |
| | | | 2 | data18 (7→5) | data12 (4→2.5) | data3 (2→1) | ↓ |
| | | | 3 | non | non | non | ↓ |
| | | | 4 | ↓ | ↓ | ↓ | ↓ |

FIG. 9

| | |
|---|---|
| data1(1→2) | 1 0 0 0 0 0 0 0 0 0 0 0 1 0 0 0 0 0 0 0 1 0 0 0 0 0 1 0 0 0 |
| data2(1→3) | 1 0 0 0 0 0 0 0 0 0 1 0 0 0 0 0 0 1 0 0 0 1 0 0 0 1 0 0 0 1 |
| data3(2→1) | 0 0 1 0 0 0 0 1 0 0 0 0 1 0 0 0 0 0 0 1 0 0 0 0 0 0 1 0 0 0 |
| data4(2→2) | 0 0 1 0 0 0 0 1 0 0 0 0 1 0 0 0 0 1 0 0 0 0 1 0 0 0 0 1 0 0 |
| data5(2→4) | 0 1 0 0 0 0 0 0 1 0 0 0 0 1 0 0 1 0 0 1 0 0 1 0 1 0 1 0 1 0 |
| data6(2→6) | 0 1 0 0 0 0 0 1 0 0 0 0 1 0 0 1 0 1 0 1 0 1 0 1 0 1 1 0 1 1 |
| data7(2.5→4) | 0 1 0 0 0 0 0 1 0 0 0 0 1 0 0 0 1 0 0 1 0 0 1 0 0 1 0 1 0 1 |
| data8(3→1) | 0 1 0 0 1 0 0 1 0 0 0 1 0 0 0 0 1 0 0 0 0 0 0 0 1 0 0 0 0 0 |
| data9(3→4) | 0 1 0 0 1 0 0 1 0 0 1 0 0 1 0 0 1 0 0 1 0 0 1 0 0 1 0 1 0 1 |
| data10(3→6) | 0 1 0 0 1 0 0 1 0 0 1 0 0 1 0 0 1 0 1 0 1 0 1 0 1 0 1 1 0 1 |
| data11(3→7) | 0 1 0 0 1 0 0 1 0 0 1 0 0 1 0 1 0 1 0 1 0 1 1 0 1 1 1 0 1 1 |
| data12(4→2.5) | 1 0 0 1 0 0 1 0 0 1 0 0 1 0 0 1 0 0 0 1 0 0 0 1 0 0 0 1 0 0 |
| data13(4→6) | 0 1 0 0 1 0 1 0 1 0 1 0 1 0 1 0 1 0 1 0 1 0 1 0 1 0 1 1 0 1 |
| data14(5→7) | 0 1 0 1 0 1 0 1 0 1 0 1 1 0 1 1 0 1 1 0 1 1 0 1 1 0 1 1 1 0 |
| data15(5→9) | 0 1 0 1 0 1 0 1 0 1 1 0 1 1 0 1 1 1 0 1 1 1 1 1 0 1 1 1 1 1 |
| data16(6→4) | 1 1 0 1 1 0 1 0 1 0 1 0 1 0 1 0 1 0 1 0 1 0 1 0 0 1 0 0 1 0 |
| data17(6→7) | 0 1 1 0 1 1 0 1 1 0 1 1 0 1 1 0 1 1 0 1 1 0 1 1 0 1 1 1 0 1 |
| data18(7→5) | 1 1 1 0 1 1 0 1 1 0 1 1 0 1 1 0 1 0 1 0 1 0 1 0 1 0 1 0 1 0 |
| data19(7→9) | 1 1 0 1 1 0 1 1 1 0 1 1 1 1 0 1 1 1 1 0 1 1 1 1 1 1 0 1 1 1 |
| data20(9→7) | 1 1 1 1 1 1 1 1 1 0 1 1 1 1 1 0 1 1 1 0 1 1 1 0 1 1 0 1 1 0 |

PRINTING APPARATUS AND POWER SUPPLY CONTROL METHOD

BACKGROUND OF THE INVENTION

1. Field of the Invention

The present invention relates to a printing apparatus and power supply control method. More particularly, this invention relates to a printing apparatus having a printhead which prints according to the inkjet method, and a power supply control method applied to the apparatus.

2. Description of the Related Art

As a conventional printing apparatus, there are known a thermal transfer printing apparatus, and an inkjet printing apparatus which prints a text, image, or the like by discharging ink onto a printing medium such as a printing sheet. The inkjet printing apparatus used as information output means (e.g., a printer, copying machine, or facsimile machine) discharges ink to print while moving the relative positions of a printing medium and inkjet printhead (to be referred to as a printhead hereinafter). The image quality of inkjet printing is determined by control of the relative speeds of the printhead and printing medium, control of the discharge timing in accordance with the relative speed control, stability of power supply to the printhead, and the like.

Inkjet printing apparatuses are generally classified into a so-called serial type and full-line type in accordance with the form of the printhead used. Of these two types, the serial type inkjet printing apparatus discharges ink to print while moving the printhead, and is widely adopted.

Some printheads for discharging ink discharge ink by the operation of a piezoelectric element, while some printheads discharge ink by creating instantaneous film boiling of ink. The printhead for boiling and discharging ink supplies discharge energy by boiling ink near a heater using thermal energy which is generated by energizing the heater arranged near an ink channel near an ink orifice.

In order to maintain high image quality, it is important to always stably supply energy for discharging ink, discharge ink under the same conditions, and thereby obtain uniform ink droplets. In actual printing operation, however, the duty ratio changes depending on image data, and the number of simultaneously energized heaters varies. The printhead driving conditions change under the influence of voltage fluctuations caused by the output current difference of the power supply unit, the difference in voltage drop caused by the resistance of the power supply line, and the like.

Conventionally, ink discharge from the printhead is so executed as to satisfy stable discharge conditions by, e.g., precisely controlling the power supply output voltage and configuring the power supply line so as to minimize the electric energy loss.

As a means for reducing a voltage drop caused by the resistance of the power supply line and stabilizing the power supply voltage, for example, Japanese Patent Publication Laid-Open No. 2003-211671 proposes a printing apparatus in which a DC/DC converter is mounted on a circuit board on a carriage unit supporting a printhead.

This arrangement greatly reduces a power supply voltage drop amount generated by the driving current of the printhead. To perform constant-voltage control, the DC/DC converter described in Japanese Patent Publication Laid-Open No. 2003-211671 executes voltage feedback control of detecting an output voltage, comparing it with the reference voltage, and regulating the switching time ratio. For this reason, the feedback circuit suffers a response delay. When the load current abruptly varies, the control circuit cannot follow such a variation. Thus, the output voltage drops upon an abrupt increase in load current and rises upon an abrupt decrease in load current.

This will be explained with reference to FIG. 11.

FIG. 11 is a timing chart showing changes in output voltage and printhead current, which occur in accordance with an image signal transferred to the printhead and a latch signal representing one cycle of printing operation.

To print an image of repetitive thick lines and blank lines, like a stripe pattern, image signals representing thick lines and blank lines are alternately transferred every cycle, and the head current abruptly changes every cycle, as shown in FIG. 11. A heater driving voltage (VH) applied to the printhead is stable at about 20 V in the steady state, and drops by $\Delta V1$ at the time interval until feedback control of the power supply circuit responds to an abrupt increase in head current. In addition, the voltage rises by $\Delta V2$ at the time interval until feedback control of the power supply circuit responds to an abrupt decrease in head current. Hence, as shown FIG. 11, the fluctuation width of the output voltage is $\Delta V1+\Delta V2=\Delta V$. Unless the voltage fluctuation width ($\Delta V$) is within a predefined value (tolerable fluctuation range of the power supply voltage) for stabilizing driving of the printhead, an ink discharge failure occurs or the service life of the printhead shortens.

In order to suppress the fluctuation width, the capacity of the output capacitor of the DC/DC converter may be increased. However, downsizing is demanded of the DC/DC converter arranged at a movable portion such as the carriage, in addition to the printhead. It is not preferable in terms of size and cost to use a large-capacity capacitor.

In order to meet this requirement, there is proposed, e.g., a technique disclosed in Japanese Patent Publication Laid-Open No. 2003-225997. Japanese Patent Publication Laid-Open No. 2003-225997 discloses a technique of counting image signals transferred to the printhead, determining the magnitude of the head current, correcting the feedback control signal of the DC/DC converter, and thereby improving the response of the power supply upon an abrupt change in head current. By using this technique fluctuations of the power supply voltage are suppressed.

In the prior art, however, the correction signal is added to the feedback circuit of the power supply circuit, complicating the design of the power control circuit. Although response characteristics improve, the stability of the feedback circuit may be impaired in the steady load state.

Thus, only a designer having the know-how to design a power supply circuit can design and develop a highly reliable power supply circuit. Further, a correction signal processing circuit and an addition circuit to a feedback signal are also necessary, increasing the product cost.

SUMMARY OF THE INVENTION

Accordingly, the present invention is conceived as a response to the above-described disadvantages of the conventional art.

For example, a method of controlling power supply and a printing apparatus to which the method is applied according to this invention is capable of stably applying a voltage upon printing operation.

According to one aspect of the present invention, preferably, there is provided a printing apparatus in which a carriage supporting a printhead comprises a discharge circuit for suppressing a driving voltage applied to the printhead, comprising: a power supply unit which supplies power to each unit of the apparatus; input means for inputting an image signal from a host apparatus; presumption means for presuming a change of a current supplied to the printhead on the basis of the image signal input by the input means; and discharge control means for generating a discharge circuit control signal to be input to the discharge circuit on the basis of the current change presumed by the presumption means, and controlling an operation of the discharge circuit by the discharge circuit control signal.

The printhead preferably includes a plurality of printing elements, a shift register which receives an image signal, a latch circuit which latches the image signal input to the shift register, a decoder which receives a block selection signal for dividing the plurality of printing elements into a plurality of blocks and time-divisionally driving the plurality of printing elements, and generates a selection signal for selecting a printing element from each of the plurality of blocks, an AND circuit which receives the selection signal from the decoder, the image signal from the latch circuit, and a heat signal for driving the plurality of printing elements, and calculates a logical product, and a driving transistor which drives the plurality of printing elements on the basis of a calculation result from the AND circuit.

The carriage preferably further comprises a DC/DC converter which receives power supplied from the power supply unit, and supplies the power to the printhead, and the discharge circuit is preferably arranged on an output side of the DC/DC converter.

The presumption means preferably includes counting means for counting, on the basis of the image signal input by the input means, pulses of an image signal which causes the printhead to print, classification means for dividing an image signal of one printing operation cycle of the printhead into a plurality of periods in a chronological order, and classifying, into a plurality of zones, count values counted by the counting means in the divided periods, as indices each representing a current value supplied to the printhead, and determination means for determining a change degree of the current supplied to the printhead in a next printing operation cycle of the printhead on the basis of a classification result of the classification means.

In this case, the determination means preferably includes holding means for holding a classification result of the classification means for a printing operation of a preceding cycle, and comparison means for comparing the classification result held by the holding means with the classification result of the classification means, and a change degree of the current is preferably determined in accordance with a comparison result.

The discharge control means preferably generates, in each of the plurality of periods, the discharge circuit control signal in consideration of at least one of a classification result in the printing operation of the preceding cycle held in the holding means, and a classification result in a period preceding to each of the plurality of periods.

In a case where it is determined by the determination means that the current greatly changes, the discharge control means preferably generates the discharge circuit control signal also representing a change degree of a discharge current in accordance with the change of the current. To the contrary, in a case where it is determined by the determination means that the current hardly changes, it is preferable that the discharge control means does not generate the discharge circuit control signal to be input to the discharge circuit.

Furthermore, in a case where it is determined by the determination means that the current greatly increases, the discharge control means preferably generates the discharge circuit control signal and controls an operation of the discharge circuit in a cycle before the current increases. On the other hand, in a case where it is determined by the determination means that the current greatly decreases, the discharge control means preferably generates the discharge circuit control signal and controls an operation of the discharge circuit at a start of a cycle in which the current decreases.

As another aspect of the present invention, the printing apparatus may further comprise a differential amplifier used to obtain information on a current supplied from the power supply unit to the DC/DC converter, an A/D converter which converts the current information output from the differential amplifier into digital information, second classification means for classifying current values supplied to the printhead into a plurality of zones on the basis of the digital current information output from the A/D converter, and comparison means for comparing the classification result of the classification means with a classification result of the second classification means, and the change degree of the current may be determined in accordance with a comparison result.

The presumption means and the discharge control means are preferably formed from an ASIC.

According to another aspect of the present invention, preferably, there is provided a power supply control method for a printing apparatus having a carriage which supports a printhead, a power supply unit which supplies power to each unit of the apparatus, and a discharge circuit which is arranged on the carriage and suppresses a driving voltage applied from the power supply unit to the printhead, comprising steps of: inputting an image signal from a host apparatus; presuming a change of a current supplied to the printhead on the basis of the image signal input at the step of inputting; and generating a discharge circuit control signal to be input to the discharge circuit on the basis of the current change presumed at the step of presuming, and controlling an operation of the discharge circuit by the discharge circuit control signal.

The invention is particularly advantageous since discharge operation by the discharge circuit which is arranged in a carriage and suppresses the printhead application voltage on the basis of an input image signal is controlled, and thus fluctuations of the head power supply voltage upon an abrupt change of the head current can be greatly suppressed.

As a result, a highly stable voltage can be applied to print at high quality. In achieving this effect, the apparatus cost does not rise because the power supply unit need not be changed and no extra component need be added.

Further features of the present invention will become apparent from the following description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 3 is a block diagram showing the arrangement of a printhead driving control unit arranged in an ASIC 603 and the internal arrangement of a carriage board;

FIGS. 6, 7, and 8 are tables showing criteria for selecting and determining the type of discharge pattern data and the application timing on the basis of a detection signal representing a load state detected from an image signal;

FIG. 9 is a view showing an example of discharge pattern data for generating a signal for controlling the discharge circuit;

DESCRIPTION OF THE EMBODIMENTS

Preferred embodiments of the present invention will now be described in detail in accordance with the accompanying drawings.

Constituent elements described in the following embodiment are merely illustrative, and the scope of the invention is not limited to them.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Furthermore, unless otherwise stated, the term "nozzle" generally means a set of a discharge orifice, a liquid channel connected to the orifice and an element to generate energy utilized for ink discharge.

<Description of Inkjet Printing Apparatus (FIG. 1)>

Figure 1:
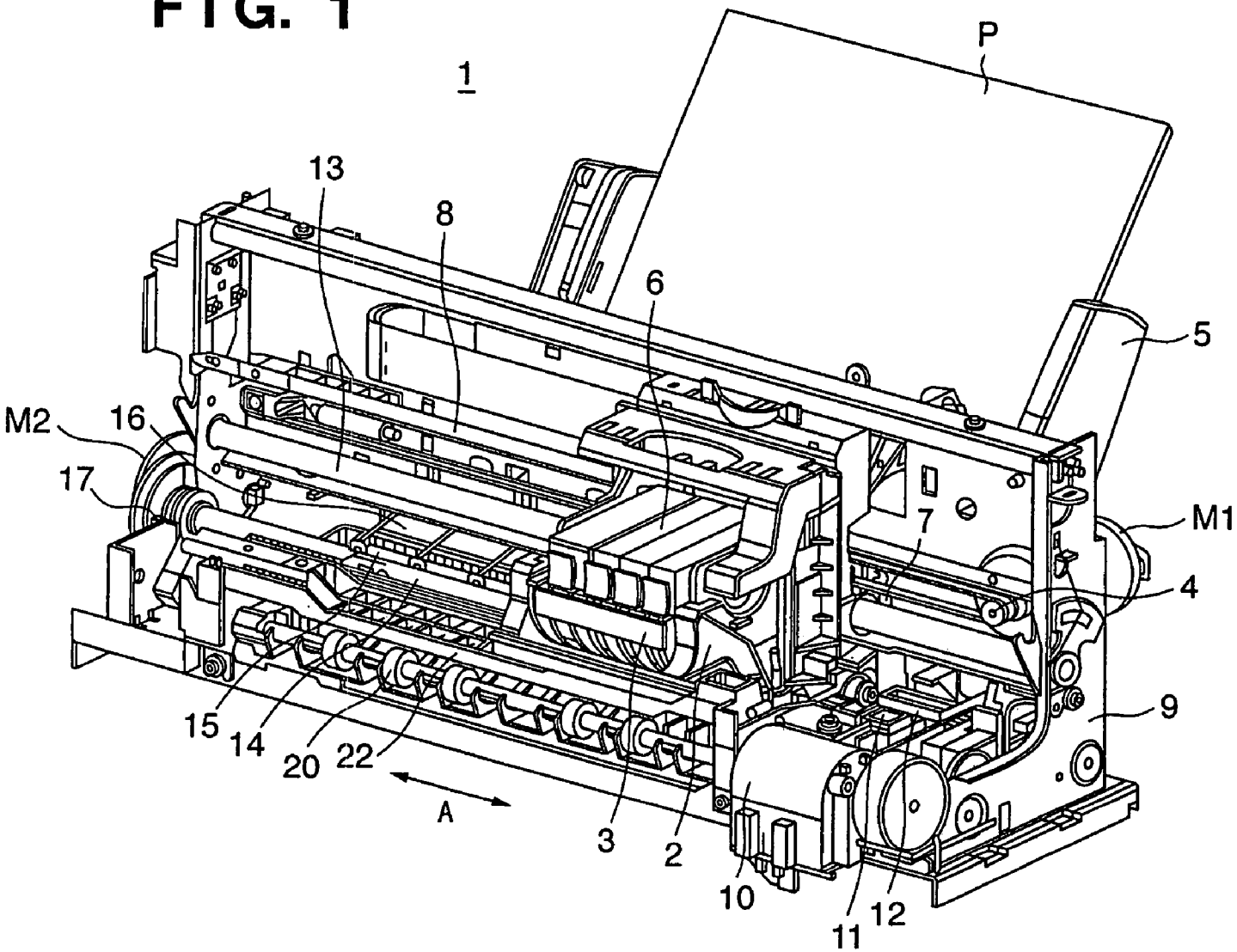
FIG. 1 is a perspective view showing the schematic structure of an inkjet printing apparatus 1 as a typical embodiment of the present invention.

FIG. 1 is a perspective view showing the schematic structure of an inkjet printing apparatus 1 as a typical embodiment of the present invention.

In the inkjet printing apparatus (to be referred to as a printing apparatus hereinafter), as shown in FIG. 1, a carriage 2 supports a printhead 3 which prints by discharging ink according to the inkjet method. A driving force generated by a carriage motor M1 is transmitted from a transmission mechanism 4 to the carriage 2, and the carriage 2 reciprocates in a direction indicated by an arrow A. In printing, a printing medium P such as a printing sheet is fed via a sheet feed mechanism 5, and conveyed to a printing position. At the printing position, the printhead 3 discharges ink to the printing medium P to print.

In order to maintain a good state of the printhead 3, the carriage 2 is moved to the position of a recovery device 10, and a discharge recovery process for the printhead 3 is executed intermittently.

The carriage 2 of the printing apparatus 1 supports not only the printhead 3, but also an ink cartridge 6 which stores ink to be supplied to the printhead 3. The ink cartridge 6 is detachable from the carriage 2.

The printing apparatus 1 shown in FIG. 1 can print in color. For this purpose, the carriage 2 supports four ink cartridges which respectively store magenta (M), cyan (C), yellow (Y), and black (K) inks. The four ink cartridges are independently detachable.

The carriage 2 and printhead 3 can achieve and maintain a predetermined electrical connection by properly bringing their contact surfaces into contact with each other. The printhead 3 selectively discharges ink from a plurality of orifices and prints by applying energy in accordance with the printing signal. In particular, the printhead 3 according to this embodiment employs an inkjet method of discharging ink by using thermal energy. For this purpose, the printhead 3 comprises an electrothermal transducer for generating thermal energy. Electric energy applied to the electrothermal transducer is converted into thermal energy, and ink is discharged from orifices by using a change in pressure upon growth and contraction of bubbles by film boiling generated by applying the thermal energy to ink. The electrothermal transducer is arranged in correspondence with each orifice, and ink is discharged from a corresponding orifice by applying a pulse voltage to a corresponding electrothermal transducer in accordance with the printing signal.

As shown in FIG. 1, the carriage 2 is coupled to part of a driving belt 7 of the transmission mechanism 4 which transmits the driving force of the carriage motor M1. The carriage 2 is slidably guided and supported along a guide shaft 13 in the direction indicated by the arrow A. The carriage 2 reciprocates along the guide shaft 13 by normal rotation and reverse rotation of the carriage motor M1. A scale 8 which represents the absolute position of the carriage 2 is arranged along the moving direction (direction indicated by the arrow A) of the carriage 2. In this embodiment, the scale 8 is prepared by printing black bars on a transparent PET film at a necessary pitch. One end of the scale 8 is fixed to a chassis 9, and its other end is supported by a leaf spring (not shown).

The printing apparatus 1 has a platen (not shown) facing the orifice surface of the printhead 3, which has orifices (not shown). The carriage 2 supporting the printhead 3 reciprocates by the driving force of the carriage motor M1. At the same time, a printing signal is supplied to the printhead 3 to discharge ink and print on the entire width of the printing medium P conveyed onto the platen.

In FIG. 1, reference numeral 14 denotes a conveyance roller which is driven by a conveyance motor M2 in order to convey the printing medium P; 15, a pinch roller which makes the printing medium P abut against the conveyance roller 14 by a spring (not shown); 16, a pinch roller holder which rotatably supports the pinch roller 15; and 17, a conveyance roller gear which is fixed to one end of the conveyance roller 14. The conveyance roller 14 is driven by rotation, of the conveyance motor M2, that is transmitted to the convey roller gear 17 via an intermediate gear (not shown).

Reference numeral 20 denotes a discharge roller which discharges the printing medium P on which an image is formed by the printhead 3 outside the printing apparatus. The discharge roller 20 is driven by transmitting rotation of the conveyance motor M2. The discharge roller 20 abuts against a spur roller (not shown) which presses the printing medium P by a spring (not shown). Reference numeral 22 denotes a spur holder which rotatably supports the spur roller.

In the printing apparatus 1, the recovery device 10 which recovers the printhead 3 from a discharge failure is arranged at a desired position (e.g., a position corresponding to the home position) outside the reciprocation range (printing area) for printing operation of the carriage 2 supporting the printhead 3.

The recovery device 10 comprises a capping mechanism 11 which caps the orifice surface of the printhead 3, and a wiping mechanism 12 which cleans the orifice surface of the printhead 3. The recovery device 10 uses a suction means (suction pump or the like) within the recovery device to forcibly discharge ink from orifices in synchronism with capping of the orifice surface by the capping mechanism 11. Accordingly, the recovery device 10 achieves a discharge recovery process of removing ink with a high viscosity or bubbles in the ink channel of the printhead 3.

In non-printing operation or the like, the orifice surface of the printhead 3 is capped by the capping mechanism 11 to protect the printhead 3 and prevent evaporation and drying of ink. The wiping mechanism 12 is arranged near the capping mechanism 11, and wipes ink droplets attached to the orifice surface of the printhead 3.

The capping mechanism 11 and wiping mechanism 12 can maintain a normal ink discharge state of the printhead 3.

<Control Arrangement of Inkjet Printing Apparatus (FIG. 2)>

Figure 2:
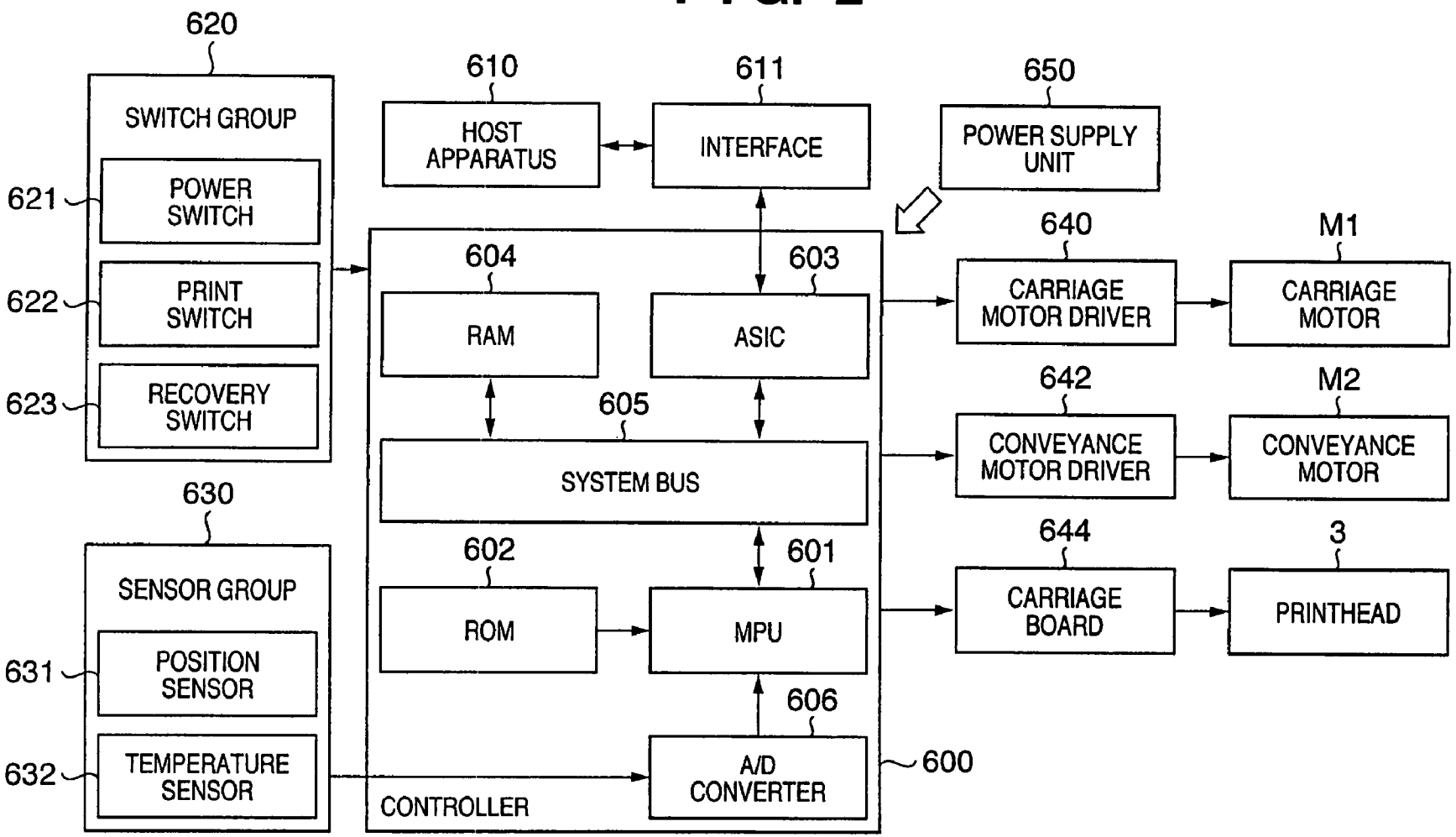
FIG. 2 is a block diagram showing the control arrangement of the printing apparatus shown in FIG. 1.

FIG. 2 is a block diagram showing the control arrangement of the printing apparatus shown in FIG. 1.

As shown in FIG. 2, a controller 600 comprises an MPU 601, ROM 602, ASIC (Application Specific Integrated Circuit) 603, RAM 604, system bus 605, and A/D converter 606. The ROM 602 stores a program corresponding to a control sequence (to be described later), a predetermined table, and other permanent data. The ASIC 603 generates control signals for controlling the carriage motor M1, conveyance motor M2, and printhead 3. The RAM 604 is used as an image data expansion area, a work area for executing a program, and the like. The system bus 605 connects the MPU 601, ASIC 603, and RAM 604 to each other, and allows exchanging data. The A/D converter 606 receives analog signals from a sensor group (to be described below), A/D-converts the analog signals, and supplies digital signals to the MPU 601.

In FIG. 2, reference numeral 610 denotes a computer (or an image reader, digital camera, or the like) which serves as an image data supply source and is generally called a host apparatus. The host apparatus 610 and printing apparatus 1 transmit/receive image data, commands, status signals, and the like via an interface (I/F) 611. The image data is input in, e.g., the raster format.

Reference numeral 620 denotes a switch group which is formed from a power switch 621, print switch 622, and recovery switch 623. The print switch 622 is used to designate the start of printing. The recovery switch 623 is used to designate the activation of a process (recovery process) of maintaining good ink discharge performance of the printhead 3. These switches are used for receiving instruction inputs from the operator.

Reference numeral 630 denotes a sensor group which detects the state of the apparatus and includes a position sensor 631 and temperature sensor 632. The position sensor 631 is, e.g., a photocoupler for detecting a home position h. The temperature sensor 632 is arranged at a proper portion of the printing apparatus, and used to detect the ambient temperature.

Reference numeral 640 denotes a carriage motor driver which drives the carriage motor M1 for reciprocating the carriage 2 in the direction indicated by the arrow A; 642, a conveyance motor driver which drives the conveyance motor M2 for conveying the printing medium P; and 644, a carriage board which is integrated in the carriage 2, is electrically connected to the printhead 3, receives power from the printing apparatus, and transfers an image signal and control signal.

Reference numeral 650 denotes a power supply unit which supplies necessary power to each portion of the printing apparatus.

The detailed arrangement in the ASIC and a control arrangement for stabilizing a nozzle heater voltage applied to the printhead will be explained.

FIG. 3 is a block diagram showing the arrangement of a printhead driving control unit arranged in the ASIC 603 and the internal arrangement of the carriage board.

A head control block 103 exchanges signals with the MPU 601, RAM 604, carriage motor driver 640, conveyance motor driver 642, and the like, and generates, on the basis of image data transmitted from the host apparatus 610, signals for driving and controlling the printhead 3. The head control block 103 outputs these signals to the printhead 3. As shown in FIG. 3, main signals are an image signal (HDATA), latch signal (Latch), heat clock signal (HCLK), heat signal (H-ENB), block selection signal, and the like.

The ASIC 603 comprises a load amount detection/discharge control circuit 104 which performs control to stabilize a nozzle heater voltage applied to the printhead. Details of the arrangement and operation of the load amount detection/discharge control circuit 104 will be described later.

A DC/DC converter 107 is integrated on the carriage board 644 of the carriage 2. The heater driving voltage (VH) is applied to nozzle heaters 136 of the printhead 3 via the DC/DC converter 107.

Figure 4:
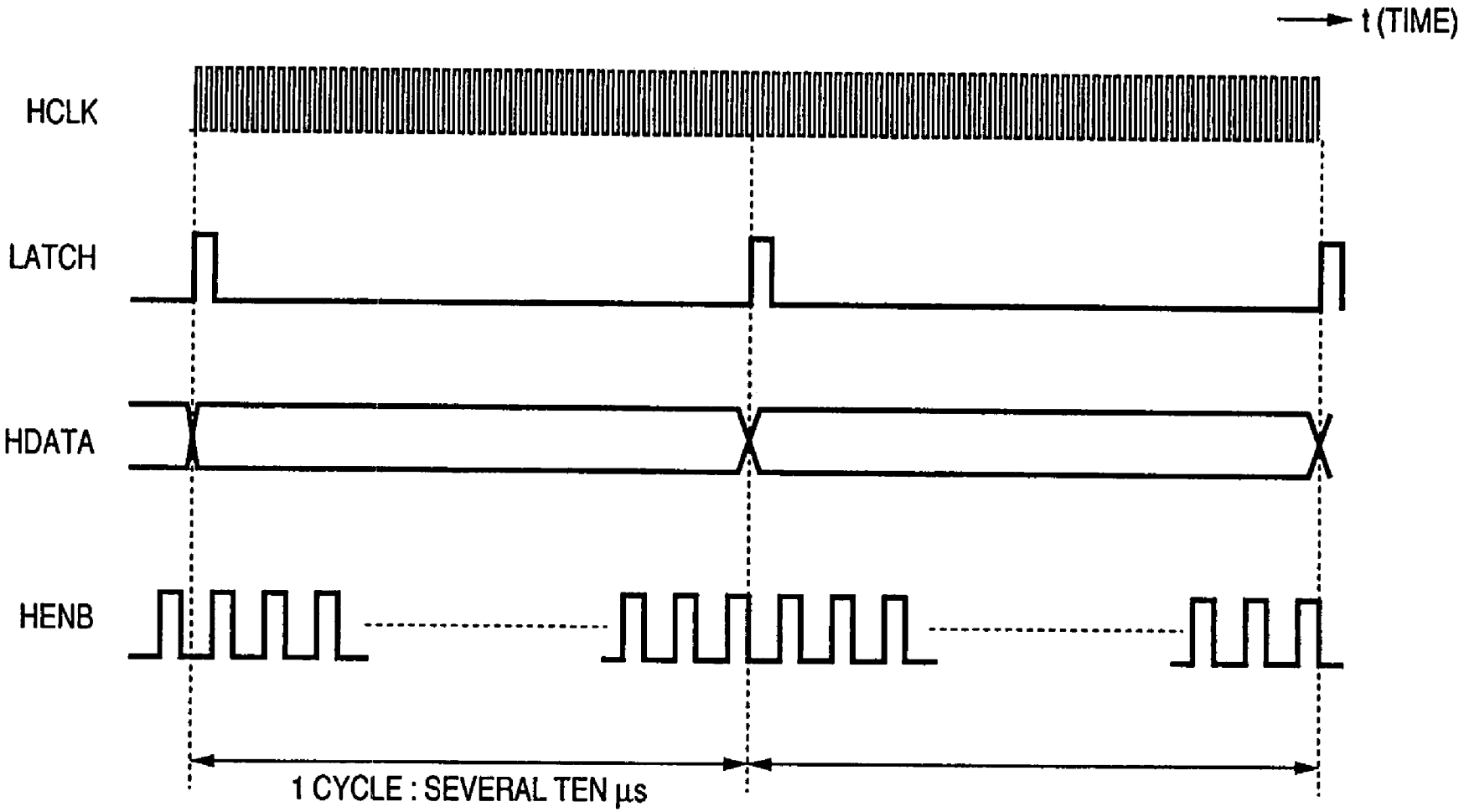
FIG. 4 is a timing chart showing a signal for controlling the operation of a printhead.

FIG. 4 is a timing chart showing a signal for controlling the operation of the printhead.

The arrangement in the ASIC, that in the printhead, and that of the carriage board shown in FIG. 3 will be further explained with reference to FIG. 4.

The image signal (HDATA) is a serial data signal for controlling the ON/OFF operation of nozzle heaters arranged in the printhead 3. The image signals are sequentially stored in shift registers 131 arranged on the printhead 3 in synchronism with the heat clock signal (HCLK). After signals are sent by the number of nozzles of the printhead, the latch signal (Latch) is sent, the image signals stored in the shift registers 131 are latched by latch circuits 132, and setting of the image signals ends.

The block selection signal is used to select and control the driving order of nozzles and the time division interval for time-divisionally driving the nozzle heaters of the printhead. The block selection signal is input to a block decoder 133 in the printhead 3, and a decoded selection signal is output to nozzle heaters to be simultaneously driven. In this embodiment, a 3-bit block selection signal is input to the block decoder 133 to divide a plurality of nozzle heaters into eight blocks and select one of the eight blocks. An image signal latched by a latch circuit 132 corresponding to a nozzle heater and a signal output from the block decoder 133 are input to an AND circuit 134 which is arranged in correspondence with the nozzle heater. The AND circuit 134 further receives the heat signal (H-ENB). When all signals input to the AND circuit 134 change to high level, a driving transistor 165 connected to a nozzle heater 136 corresponding to each nozzle operates, and the heat current flows through the nozzle heater. The heat signal (H-ENB) is set to a pulse width for supplying an electric energy necessary to properly set an ink amount to be discharged from the nozzle. The pulse width is adjusted in accordance with variations in heater resistance, variations in ambient temperature, and the like.

The above driving operation is controlled for all the nozzle heaters of the printhead. By successively executing the block division operation, ink droplets are discharged onto desired positions to realize a series of printing operations.

It is, therefore, possible to specify a heater driven at a timing one cycle before the operation of actually driving the heater on the basis of the image signal (HDATA) output from the head control block 103. That is, a heater driving current flowing in the next cycle can be presumed by reading the image signal.

In this embodiment, voltage fluctuations are suppressed using the load amount detection/discharge control circuit (to be described later) on the basis of the driving current of the next cycle that is presumed from the image signal.

How to reduce fluctuations of a voltage output from the DC/DC converter upon an abrupt change in load current, which have been described in Description of the Related Art, will be explained.

In a general DC/DC converter, when the load current is constant or varies slightly, the ON/OFF time ratio of the switching element is constant, the input and output currents are well-balanced, and the output voltage takes a stable value. However, if the load current changes, the balance between the input and output currents is disturbed, and if the load current increases, the output voltage drops. To prevent this, feedback control is performed to detect the output voltage drop, prolong the ON time of the switching element, compensate for the input current, and thereby return the output voltage to a predefined value. For this reason, a time delay occurs along with feedback control, and a response time delay of several ten μs to several hundred μs is generated in a general power supply circuit.

Figure 11:
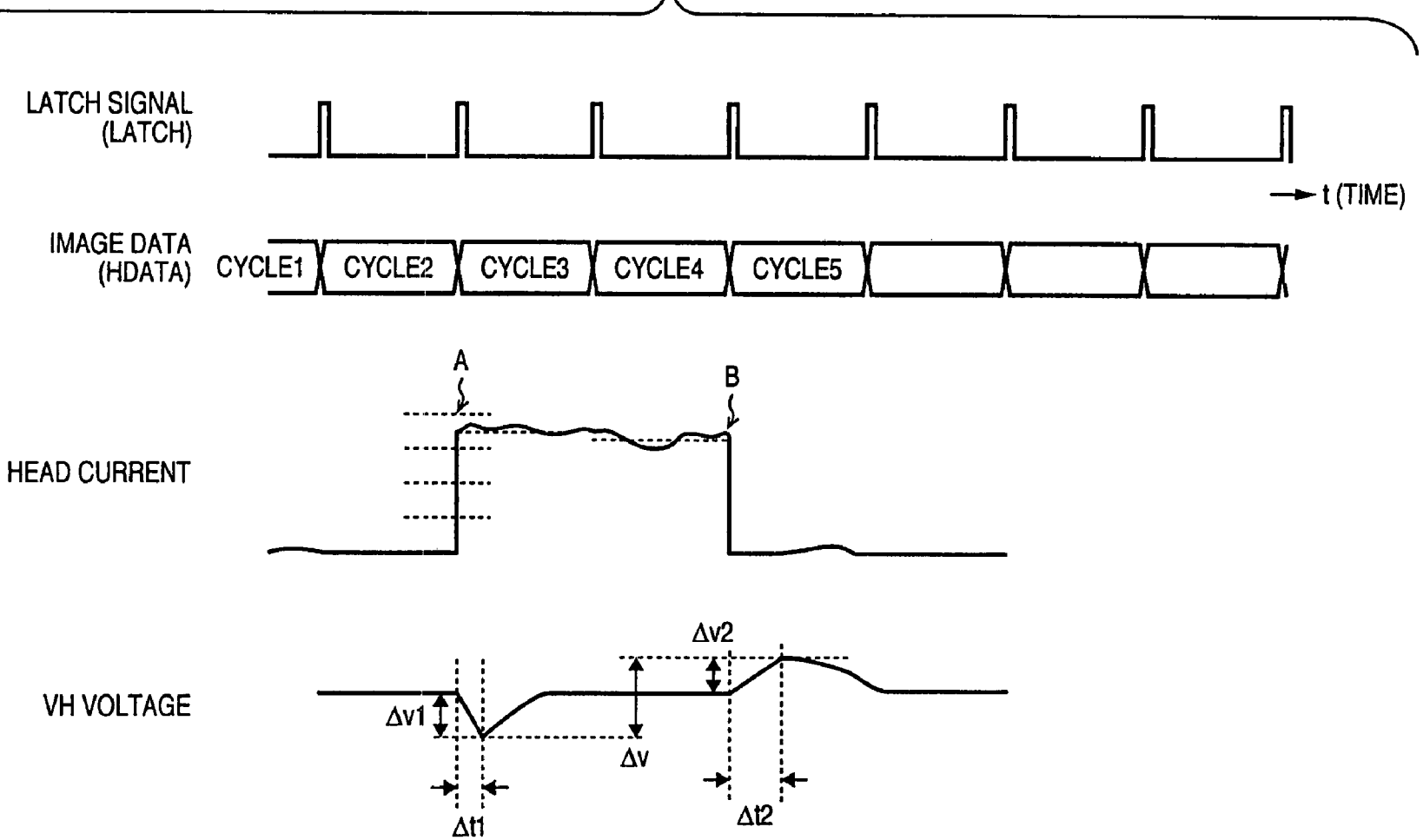
FIG. 11 is a timing chart showing changes in an output voltage and a current which is generated in accordance with an image signal transferred to the printhead and a latch signal representing one cycle of printing operation and flows through the printhead.

The printhead serving as a load is driven while the carriage is moved. The driving period necessary to give a chance to discharge ink once by all the nozzle heaters of the printhead is called one cycle. Hence, one cycle is also defined as a unit time to print by one array of nozzle heaters of the printhead in the carriage moving direction (main scanning direction). In general, one cycle is several ten μs, which is the driving period. For example, for an image formed by repeating thick lines and blank lines, like a stripe pattern, the head current abruptly changes every cycle, as shown in FIG. 11. At a boundary point A between cycles 2 and 3, the head current sometimes instantaneously changes from a no-load current to a maximum one.

If the load abruptly increases in this manner, for example, the response of the DC/DC converter 107 shown in FIG. 3 cannot follow it, and the load current is supplied from a capacitor (e.g., 122 in FIG. 3) arranged at the output terminal of the DC/DC converter 107. As a result, the heater driving voltage (VH) drops by $\Delta V1$ in the period of the response time $\Delta t1$ of the DC/DC converter, as shown in FIG. 11. If the head current instantaneously changes from a maximum current to a no-load one at a boundary point B between cycles 4 and 5, as shown in FIG. 11, the current on the input side of the output capacitor 122 becomes excessive, and the heater driving voltage (VH) rises by $\Delta V2$ in the period of the response time $\Delta t2$ of the DC/DC converter.

In order to suppress such voltage fluctuations, an arrangement to correct the current is integrated in the ASIC 603 and carriage board 644 in the embodiment.

Figure 5:
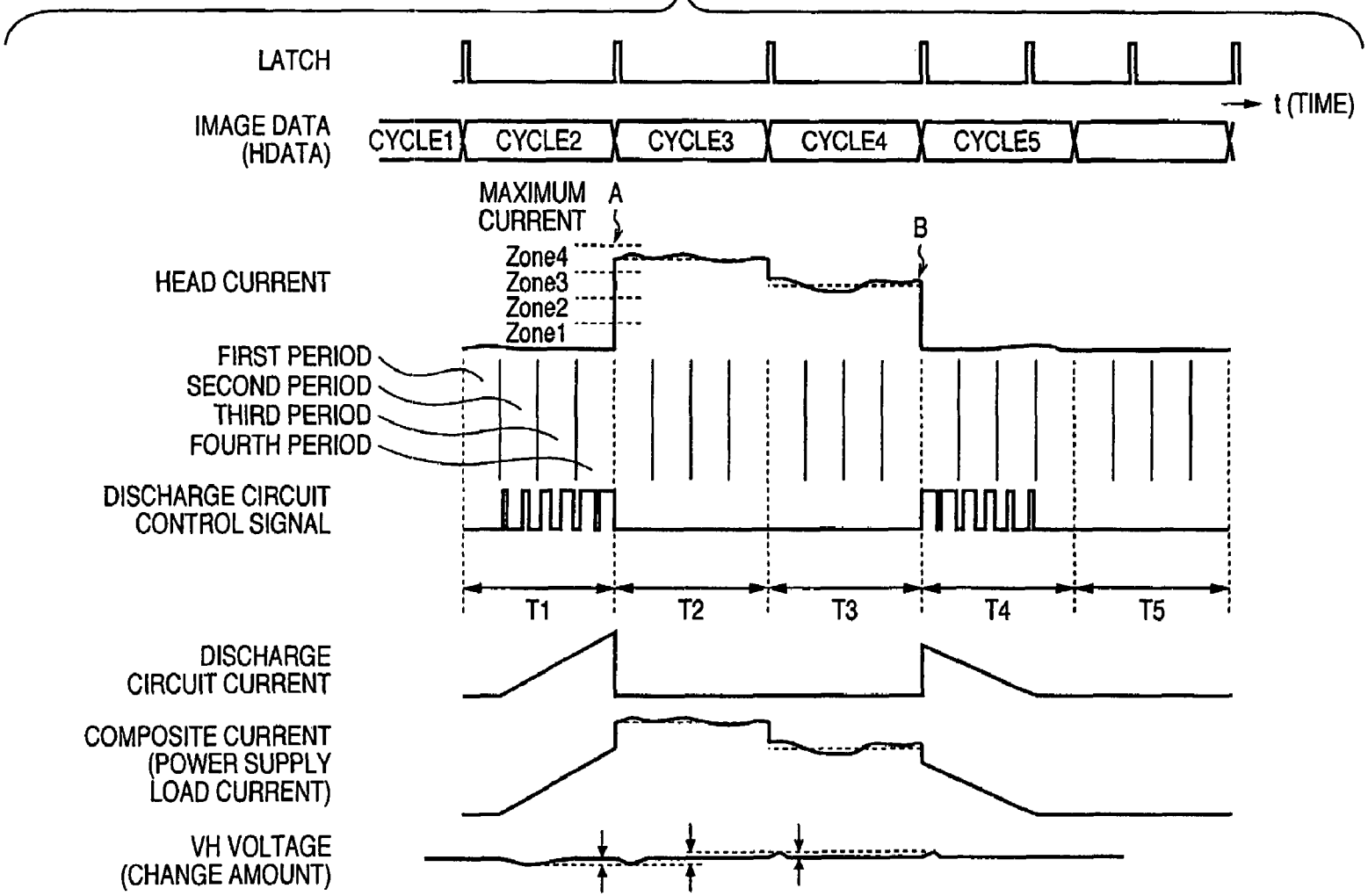
FIG. 5 is a timing chart showing the change amounts of a control signal, discharge current, composite current, and output voltage in a discharge circuit used to reduce the waveform change of the load current and the temporal change of the current.

FIG. 5 is a timing chart showing the change amounts of a control signal, discharge current, composite current, and output voltage in the discharge circuit used to reduce the waveform change of the load current and the temporal change of the current.

As described with reference to FIG. 11, the head driving current may abruptly change every cycle. However, if a current of a waveform, like a discharge circuit current shown in FIG. 5, is generated, a change of the DC/DC converter load current serving as a composite current of this current and the head current becomes more relaxed. At the change point A where the head current starts flowing, as shown in FIGS. 5 and 11, the power supply circuit can respond to the change, thus greatly reducing fluctuations of the heater driving voltage (VH). Similarly, voltage rise can also be suppressed at the change point B.

The head power supply of the printing apparatus comprises a discharge circuit for reducing the head voltage in exchange of the printhead or the standby state. The discharge circuit is arranged by, e.g., series-connecting a resistor 123 and switching element 124, as shown in FIG. 3. If voltage fluctuations are suppressed using this discharge circuit, no new circuit need be added. As the switching element 124, for example, a MOS transistor is used. The value of the resistor 123 is set to a value with which the discharge current becomes equal to or lower than the maximum value of the head load current when the switching element 124 is closed. The ON/OFF time ratio of the switching element 124 is changed on the basis of the discharge circuit control signal, thereby changing the average value of the discharge current.

As indicated from the discharge circuit control signal shown in FIG. 5, the discharge circuit is operated to gradually increase the ON time of this signal. By doing so, the average value of the discharge current, i.e., a current smoothed by the capacitor 122 becomes the triangular wave, similar to the discharge circuit current shown in FIG. 5.

A feature of the present invention is to generate the discharge circuit control signal on the basis of the image signal. As the arrangement to generate this control signal, the following two embodiments will be explained.

First Embodiment

A method of generating a discharge circuit control signal according to the first embodiment will be explained with reference to FIGS. 3 and 5.

As described above, it is possible to specify a nozzle heater driven at a timing one cycle before the printing operation of actually driving the nozzle heater on the basis of the image signal (HDATA) output from a head control block 103. That is, a heater driving current flowing in the next cycle can be presumed by reading the image signal.

However, if the head current abruptly increases, as represented at the change point A in FIG. 5, the discharge current must be supplied before the head current of the next cycle that is detected from the image signal is determined (see the period T1 in FIG. 5). If the head current abruptly decreases, as represented at the change point B in FIG. 5, the discharge current suffices to be supplied after the head current of the next cycle that is detected from the image signal is determined, i.e., at the start timing of the next cycle (see the period T3 in FIG. 5).

In the first embodiment, therefore, one cycle is divided into a plurality of periods (e.g., four periods), and the image signal is estimated at the end of each period.

This estimation method will be explained together with the arrangement of a load amount detection/discharge control circuit 104 shown in FIG. 3.

An image signal counter 112 counts image signals (HDATA) at the start of each cycle, and counts the number of signal pulses which cause ink discharge. At the end of each period described above, the count value is classified into one of four zones (Zone 1 to Zone 4) on the basis of the magnitude. The count value is used as an index corresponding to a current value, and count values are classified into Zone 1, Zone 2, Zone 3, and Zone 4 in the ascending order of count values. The calculation to classify the count value of the image signal into a zone will be called "estimation of the image signal". In FIG. 3, reference numeral 113 denotes a first period zone detection circuit; 114, a second period zone detection circuit; 115, a third period zone detection circuit; and 116, a present cycle zone detection circuit.

Reference numeral 111 denotes a period selection signal generation circuit. Each of the four zone detection circuits 113 to 116 estimates the count value of the image signal counter 112 at the end of a period designated by an output from the period selection signal generation circuit 111. That is, the zone value is data representing the magnitude of the load current of the next cycle.

An algorithm to presume an abrupt change of the head current from an estimated image signal will be explained.

In FIG. 5, the head current in the period T1 is obtained from the estimation result of image data before one cycle (i.e., cycle 1). In the first embodiment, the zone estimation result of the preceding cycle is held in a preceding cycle zone holding circuit 117, and compared with the zone estimation of the present cycle to presume variations of the head current.

Table 1 is a list used to determine whether to operate the discharge circuit in accordance with the state of a detection signal obtained by detecting the load state of the printhead from an image signal and classifying the magnitude of the load into a zone.

TABLE 1

| | | Present Cycle | | | |
|---|---|---|---|---|---|
| | | Zone 1 | Zone 2 | Zone 3 | Zone 4 |
| Preceding Cycle | Zone 1 | X | X | ○ | ◎ |
| | Zone 2 | X | X | X | ○ |
| | Zone 3 | ○ | X | X | X |
| | Zone 4 | ◎ | ○ | X | X |

According to table 1, when the estimation of the preceding cycle is Zone 4 and that of the present cycle is Zone 1, it is determined that the head current will abruptly decrease in the next cycle. When the estimation of the preceding cycle is Zone 1 and that of the present cycle is Zone 4, it is determined that the head current will abruptly increase in the next cycle. In table 1, "◎" represents that fluctuations of the load current maximize, "○" represents that the load current fluctuates to a certain degree, and "x" represents that the load current need not be corrected.

A discharge circuit control signal selection circuit 118 selects the signal pattern of the discharge circuit control signal on the basis of the determination result.

(1) Case Where Load Increases Abruptly

When the head current increases abruptly (the preceding cycle exhibits Zone 1 or Zone 2), one cycle is divided into four periods, and discharge control is performed at the end of each period, as described above. That is, the discharge circuit control signal selection circuit 118 outputs a discharge circuit control signal for the second period on the basis of the estimation result at the end of the first period. Similarly, the discharge circuit control signal selection circuit 118 outputs a discharge circuit control signal for the third period on the basis of the estimation result at the end of the second period, and a discharge circuit control signal for the fourth period on the basis of the estimation result at the end of the third period.

In the first period, ¼ of image data of the whole cycle is estimated, and the estimation result may change in the second and subsequent periods depending on input image signals. Considering this, a signal containing the discharge circuit control signal of the preceding period is selected in discharge circuit control signal selection operation in the second and subsequent periods. This will be described in detail later.

(2) Case Where Load Decreases Abruptly

When the head current decreases abruptly (the preceding cycle exhibits Zone 3 or Zone 4), discharge control is performed at the end of one cycle. That is, the discharge circuit control signal selection circuit 118 outputs a discharge circuit control signal from the start of the next cycle on the basis of the determination result of one whole cycle.

The above overview of discharge control data selection operation will be explained in more detail.

FIGS. 6 to 8 are tables showing criteria for selecting and determining the type of discharge pattern data and the application timing on the basis of a detection signal indicating a load state detected from an image signal.

Especially when the load increases abruptly, the discharge control data pattern in each period is selected and output on the basis of criteria shown in FIGS. 6 and 7. The discharge control data pattern is written in advance in the internal memory (not shown) of the ASIC.

FIG. 9 is a view showing an example of discharge pattern data for generating a signal for controlling the discharge circuit. The example of FIG. 9 shows 20 (types) data patterns (data 1 to data 20), and each data pattern outputs a combination pattern of 30 "0"s or "1"s. These patterns are selected and output as discharge circuit control signals from the discharge circuit control signal selection circuit 118. When discharge circuit control signals having a combination pattern of "0"s and "1"s are supplied to the gate of a switching element 124 formed from a MOS transistor, the source-drain current flows in accordance with the signals, and the MOS transistor switches. For example, for data 15, when the data are read out from the left to right in FIG. 9, a discharge circuit control signal corresponding to "0" is supplied to the gate of the switching element 124. Then, a discharge circuit control signal corresponding to "1" is supplied to the gate of the switching element 124. Subsequently, discharge circuit control signals corresponding to "0", "1", . . . are sequentially supplied to the gate of the switching element 124.

FIG. 6 shows a criterion used when the estimation result of the preceding cycle is Zone 1. As shown in FIG. 6, the discharge circuit control signal output in the second period of the present cycle is set from a corresponding portion shown in FIG. 6 on the basis of the result of a comparison with the estimation value of the first period of the present cycle. The history of the estimation value of the preceding period is considered for the estimation value of the second period, and the discharge circuit control signal output in the third period of the present cycle shown in FIG. 6 is set from a corresponding portion shown in FIG. 6. This also applies to the third period.

A portion "non" in FIG. 6 represents that no discharge control data is output. Values parenthesized after the data number represent transition of the discharge current assuming that the maximum value of the discharge current is defined as "10". The discharge pattern is flexible based on the estimation result of each period.

For example, when the preceding cycle exhibits Zone 1 and the classification of the present cycle in the first period is Zone 1 or 2, it is determined that the current hardly varies, and no discharge circuit control signal is output. In this case, no discharge control is performed. To the contrary, when the preceding cycle exhibits Zone 1 and the classification of the present cycle in the first period is Zone 3, it is determined that the current varies to a certain degree, and the discharge circuit control signal is so generated as to change the discharge current from level 1 to level 2 in the second period. When the preceding cycle exhibits Zone 1 and the classification of the present cycle in the first period is Zone 4, it is determined that current variations maximize, and the discharge circuit control signal is so generated as to change the discharge current from level 1 to level 3 in the second period. For example, in FIG. 5, the discharge circuit control signal is generated in the second period of T1.

For example, when the preceding cycle exhibits Zone 1 and the classification of the present cycle in the second period is Zone 3, it is determined that the current varies to a certain degree, and the classification result of the first period of the present cycle is also considered in generating a discharge circuit control signal. For example, if the classification of the first period is Zone 2, the discharge circuit control signal is so generated as to change the discharge current from level 2 to level 4 in the third period. For example, in FIG. 5, the discharge circuit control signal is generated in the third period of T1.

For example, when the preceding cycle exhibits Zone 1 and the classification of the present cycle in the third period is Zone 4, it is determined that the current varies to a certain degree, and the classification results of the first and second periods of the present cycle are also considered in generating a discharge circuit control signal. For example, if the classifications of the first and second periods are Zone 3 and Zone 3, respectively, the discharge circuit control signal is so generated as to change the discharge current from level 5 to level 9 in the fourth period. That is, data 15 shown in FIG. 9 is selected as discharge control data. For example, in FIG. 5, the discharge circuit control signal is generated in the fourth period of T1.

On the contrary, when the preceding cycle exhibits Zone 1 and the classification of the present cycle in the third period is Zone 3, it is determined that the current varies to a certain degree, and the classification results of the first and second periods of the present cycle are also considered in generating a discharge circuit control signal. For example, if the classifications of the first and second periods are Zone 1 and Zone 2, respectively, it is determined that the current varies gently, and no discharge circuit control signal is generated in the fourth period.

FIG. 7 shows a criterion used when the estimation result of the preceding cycle is Zone 2. The determination operation is the same as that shown in FIG. 6.

FIG. 8 shows a criterion representing a discharge pattern used when the head current decreases abruptly (the preceding cycle exhibits Zone 4 or Zone 3). Determination is based on the estimation result of the entire present cycle.

For example, when the preceding cycle exhibits Zone 3 and the cumulative classification of the first to fourth periods of the present cycle is one of Zone 2 to Zone 4, it is determined that the current hardly varies, and no discharge circuit control signal is output through all the periods of the next cycle. In this case, no discharge control is executed.

In contrast, when the preceding cycle exhibits Zone 4 and the cumulative classification of the first to fourth periods of the present cycle is Zone 1, it is determined that the current greatly varies, and the discharge circuit control signal is so generated as to change the discharge current from level 9 to level 7 in the first period of the next cycle. Further, the discharge circuit control signal is so generated as to change the discharge current from level 6 to level 4 in the second period and from level 3 to level 1 in the third period. For example, in FIG. 5, the discharge circuit control signal is generated in T4.

In FIGS. 6 to 8, the zone result of the preceding cycle is held in the preceding cycle zone holding circuit 117.

According to the first embodiment described above, it is determined on the basis of two successive cycles of image signals serially input from the host apparatus whether or not the current supplied to the printhead abruptly changes. The discharge circuit control signal to be input to the DC/DC converter is generated on the basis of the determination result, and a voltage change in the DC/DC converter can be corrected.

The voltage can be stably applied to the printhead to always print at high quality.

Since the load amount detection/discharge control circuit 104 is arranged as part of the ASIC of the printing apparatus main body, no circuit component need be added outside the printing apparatus. Note that the discharge circuit is generally arranged in a conventional head power supply circuit. In implementing the first embodiment, no component need be added to the power supply circuit. The DC/DC converter which applies the head power supply voltage can adopt a conventional circuit without any change, obviating the need for a complicated design of the feedback control circuit.

In the first embodiment, current variations are predicted on the basis of image signals used for actual printing, and discharge control is performed to stabilize the voltage (decrease the current change amount per unit time). Thus, a large-capacity output capacitor need not be used, which is used to stabilize the voltage in a conventional DC/DC converter. Hence, the output capacitor can be downsized, contributing to downsizing of the DC/DC converter. This effect is great especially when the head driving power supply is configured on the carriage board.

Second Embodiment

In the first embodiment, the discharge circuit control signal is generated using the estimation value of an image signal in the preceding cycle. In the second embodiment, the input current of the DC/DC converter in the period of the present cycle is detected, and the discharge circuit control signal is generated on the basis of the detection result. Note that the method of estimating an image signal in the present cycle, and the discharge control pattern selection algorithm are the same as those in the first embodiment.

Figure 10:
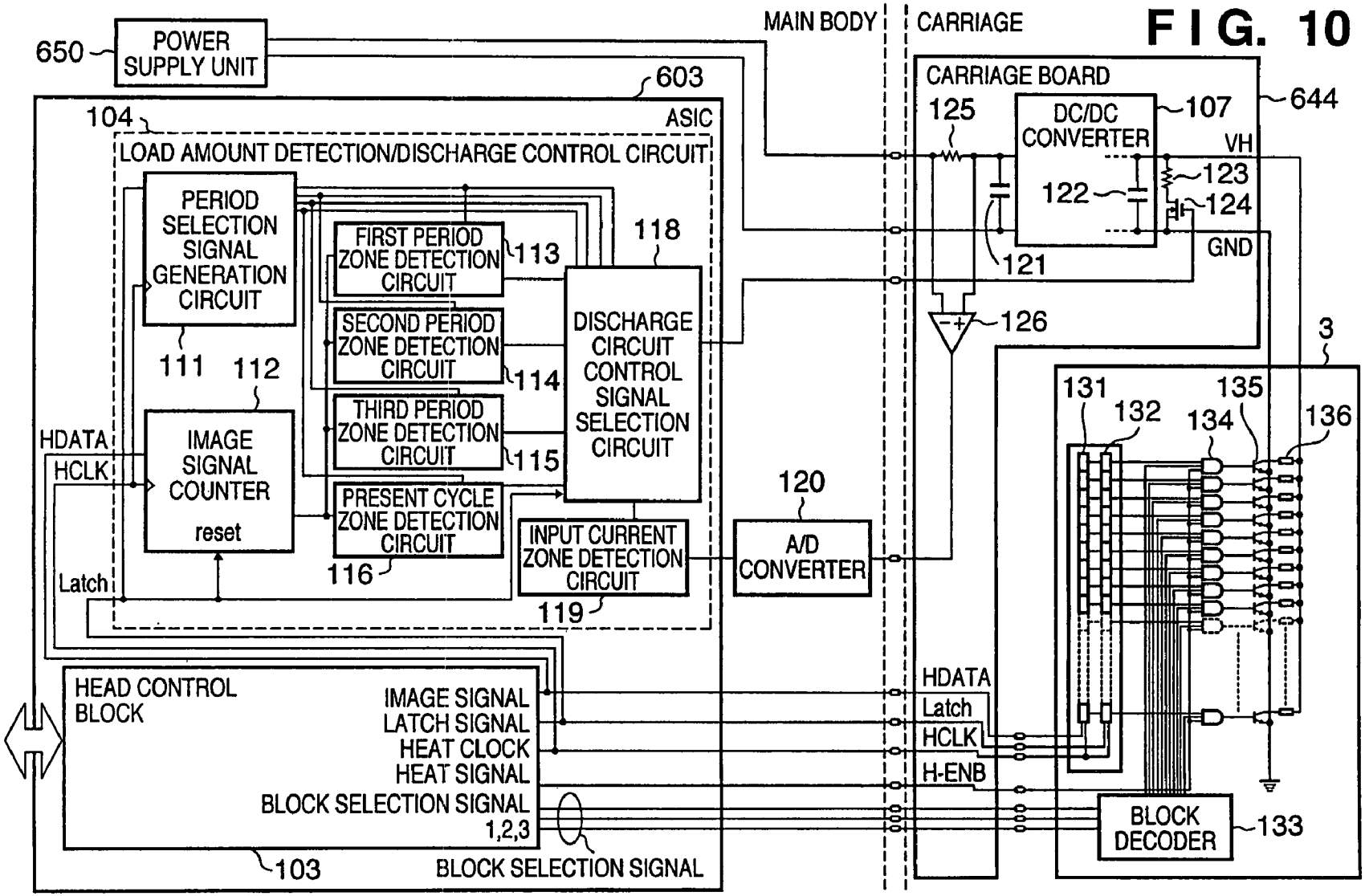
FIG. 10 is a block diagram showing the arrangement of a printhead driving control unit arranged in an ASIC 603 and the internal arrangement of a carriage board according to the second embodiment.

FIG. 10 is a block diagram showing the arrangement of a printhead driving control unit arranged in an ASIC 603 and the internal arrangement of a carriage board according to the second embodiment. In FIG. 10, the same reference numerals as those in FIG. 3 denote the same building elements, and a description thereof will be omitted.

In FIG. 10, reference numeral 125 denotes a resistor for detecting an input current; and 126, a differential amplifier used to receive voltages from the two ends of the resistor 125 and obtain a current value supplied from a power supply unit 650 on the basis of the voltage difference. Reference numeral 120 denotes an A/D converter which receives current data obtained from the differential amplifier 126 and converts it into a digital value. Reference numeral 119 denotes an input current zone detection circuit which estimates a current value input from the A/D converter 120 and classifies the estimation value into one of several zones (e.g., four zones). It is not preferable to connect the output side of a DC/DC converter 107 to a circuit which causes voltage fluctuations. For this reason, in the second embodiment, the current on the input side of the DC/DC converter 107 is detected, as shown in FIG. 10. However, if the detection circuit does not cause any fluctuations of the output voltage, the output current may be detected.

Table 2 is a list used to determine whether to operate the discharge circuit in accordance with the state of a detection signal obtained by detecting a load state from the input signal of the power supply circuit and image signal, and classifying the magnitude of the load into a zone.

TABLE 2

| | | Present Cycle | | | |
|---|---|---|---|---|---|
| | | Zone 1 | Zone 2 | Zone 3 | Zone 4 |
| Input Current | Zone 1 | X | X | ○ | ◎ |
| | Zone 2 | X | X | X | ○ |
| | Zone 3 | ○ | X | X | X |
| | Zone 4 | ◎ | ○ | X | X |

According to table 2, when the estimation of the input current is Zone 4 and that of the present cycle is Zone 1, it is determined that the head current will abruptly increase in the next cycle. When the estimation of the input current is Zone 1 and that of the present cycle is Zone 4, it is determined that the head current will abruptly decreases in the next cycle.

Also in table 2, similar to table 1, "◎" represents that fluctuations of the load current maximize, "○" represents that the load current fluctuates to a certain degree, and "x" represents that the load current need not be corrected.

According to the second embodiment described above, it is determined on the basis of image signals of the present cycle serially input from the host apparatus, and an input current supplied from the power supply unit to the DC/DC converter whether or not the current supplied to the printhead abruptly changes. This means that it is determined from a comparison between an image signal used for printing operation in the next cycle and an input current supplied for the present printing operation whether or not the supply current abruptly changes. The discharge circuit control signal to be input to the DC/DC converter is generated on the basis of the determination result, and a voltage change in the DC/DC converter can be corrected.

Note that the first and second embodiments have described specific examples of the circuit arrangement and functional blocks in the ASIC. However, the present invention is not limited to the arrangements specified by the drawings (FIGS. 3 and 10) as far as the above-described operation can be implemented. In the first and second embodiments, the printhead driving power supply adopts the DC/DC converter arranged on the carriage board. However, the present invention is not limited to this, and can also employ an arrangement of supplying printhead driving power directly from the power supply unit 650 without using the DC/DC converter.

In the above embodiments, droplets discharged from the printhead are ink, and a liquid contained in the ink tank is ink. The content of the ink tank is not limited to ink. For example, the ink tank may contain a processed liquid to be discharged onto a printing medium in order to increase the fixing properties, water repellency, and image quality.

The printhead may be of a full-line type having a length corresponding to a maximum printing medium width printable by the printing apparatus.

In the above embodiments, the inkjet printing method uses a means (e.g., an electrothermal transducer or laser beam) for generating thermal energy as energy utilized to discharge ink. The ink state is changed by thermal energy, achieving high printing density and high resolution.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-224597 filed Aug. 2, 2005, which is hereby incorporated by reference herein in its entirety.

What is claimed is:

1. A printing apparatus in which a carriage supporting a printhead comprises a discharge circuit for suppressing a driving voltage applied to the printhead, comprising:

a power supply unit which supplies power to each unit of the apparatus;

input means for inputting an image signal from a host apparatus;

presumption means for presuming a change of a current supplied to the printhead on the basis of the image signal input by said input means; and discharge control means for generating a discharge circuit control signal to be input to the discharge circuit on the basis of the current change presumed by said presumption means, and controlling an operation of the discharge circuit by the discharge circuit control signal.

2. The apparatus according to claim 1, wherein the printhead includes:

a plurality of printing elements;

a shift register which receives the image signal;

a latch circuit which latches the image signal input to the shift register;

a decoder which receives a block selection signal for dividing the plurality of printing elements into a plurality of blocks and time-divisionally driving the plurality of printing elements, and generates a selection signal for selecting a printing element from each of the plurality of blocks;

an AND circuit which receives the selection signal from the decoder, the image signal from the latch circuit, and a heat signal for driving the plurality of printing elements, and calculates a logical product; and a driving transistor which drives the plurality of printing elements on the basis of a calculation result from the AND circuit.

3. The apparatus according to claim 2, wherein said presumption means includes:

counting means for counting, on the basis of the image signal input by said input means, pulses of the image signal which causes the printhead to print;

classification means for dividing the image signal of one printing operation cycle of the printhead into a plurality of periods in a chronological order, and classifying, into a plurality of zones, count values counted by said counting means in the divided periods, as indices each representing a current value supplied to the printhead; and determination means for determining a change degree of the current supplied to the printhead in a next printing operation cycle of the printhead on the basis of a classification result of said classification means.

4. The apparatus according to claim 3, wherein said determination means includes:

holding means for holding a classification result of said classification means for a printing operation of a preceding cycle; and comparison means for comparing the classification result held by said holding means with the classification result of said classification means, wherein the change degree of the current is determined in accordance with a comparison result of said comparison means.

5. The apparatus according to claim 4, wherein the discharge circuit control signal is generated in each of the plurality of periods in consideration of at least one of a classification result in the printing operation of the preceding cycle held in said holding means, and a classification result in a period preceding each of the plurality of periods.

6. The apparatus according to claim 5, wherein when said determination means determines that the current greatly changes, said discharge control means generates the discharge circuit control signal to be input to the discharge circuit.

7. The apparatus according to claim 6, wherein the generated discharge circuit control signal represents a change degree of a discharge current in accordance with the change of the current.

8. The apparatus according to claim 6, wherein in a case where said determination means determines that the current greatly increases, said discharge control means generates the discharge circuit control signal and controls an operation of the discharge circuit in a cycle before the current increases.

9. The apparatus according to claim 6, wherein in a case where said determination means determines that the current greatly decreases, said discharge control means generates the discharge circuit control signal and controls an operation of the discharge circuit at a start of a cycle in which the current decreases.

10. The apparatus according to claim 3, further comprising:

a differential amplifier used to obtain information on a current supplied from said power supply unit to a DC/DC converter, which receives power supplied from said power supply unit, and supplies the power to the printhead;

an A/D converter which converts the current information output from said differential amplifier into digital information;

second classification means for classifying current values supplied to the printhead into a plurality of zones on the basis of the digital current information output from said A/D converter; and comparison means for comparing the classification result of said classification means with a classification result of said second classification means, wherein the change degree of the current is determined in accordance with a comparison result of said comparison means.

11. The apparatus according to claim 5, wherein when said determination means determines that the current hardly changes, said discharge control means does not generate the discharge circuit control signal to be input to the discharge circuit.

12. The apparatus according to claim 1, further comprising a DC/DC converter which is arranged on the carriage, receives power supplied from the power supply unit, and supplies the power to the printhead, wherein the discharge circuit is arranged on an output side of said DC/DC converter.

13. The apparatus according to claim 1, wherein said presumption means and said discharge control means are formed in an ASIC.

14. A power supply control method for a printing apparatus having a carriage which supports a printhead, a power supply unit which supplies power to each unit of the apparatus, and a discharge circuit which is arranged on the carriage and suppresses a driving voltage applied from the power supply unit to the printhead, comprising steps of:

inputting an image signal from a host apparatus;

presuming a change of a current supplied to the printhead on the basis of the image signal input at said step of inputting; and generating a discharge circuit control signal to be input to the discharge circuit on the basis of the current change presumed at said step of presuming, and controlling an operation of the discharge circuit by the discharge circuit control signal.

* * * * *